US011335159B2

(12) United States Patent
Pececnik

(10) Patent No.: US 11,335,159 B2
(45) **Date of Patent: *May 17, 2022**

(54) ACTIVE PLAYER CONTROLS FOR GAMING APPARATUS

(71) Applicant: Interblock d.d., Menges (SI)

(72) Inventor: Joze Pececnik, Kamnik (SI)

(73) Assignee: INTERBLOCK D.D., Menges (SI)

( * ) Notice: Subject to any disclaimer, the term of this patent is extended or adjusted under 35 U.S.C. 154(b) by 27 days.

This patent is subject to a terminal disclaimer.

(21) Appl. No.: 16/945,669

(22) Filed: Jul. 31, 2020

(65) Prior Publication Data

US 2020/0364969 A1 Nov. 19, 2020

Related U.S. Application Data

(63) Continuation of application No. 15/295,047, filed on Oct. 17, 2016, now Pat. No. 10,733,835.

(51) Int. Cl.
*G07F 17/32* (2006.01)

(52) U.S. Cl.
CPC ..... *G07F 17/322* (2013.01); *G07F 17/3209* (2013.01); *G07F 17/3211* (2013.01); *G07F 17/3225* (2013.01); *G07F 17/3244* (2013.01); *G07F 17/3272* (2013.01); *G07F 17/3286* (2013.01)

(58) Field of Classification Search
CPC ..... G07F 17/322; G07F 17/3209; G07F 17/3211; G07F 17/3225; G07F 17/3244; G07F 17/3272; G07F 17/3286
USPC ..... 463/17
See application file for complete search history.

(56) References Cited

U.S. PATENT DOCUMENTS

| | | | | |
|---|---|---|---|---|
| 4,260,159 | A | 4/1981 | Hoffman | |
| 4,337,945 | A | 7/1982 | Levy | |
| 5,437,452 | A | 8/1995 | Graf et al. | |
| 5,879,235 | A | 3/1999 | Kaneko et al. | |
| 7,094,150 | B2 | 8/2006 | Ungaro et al. | |
| D548,802 | S | 8/2007 | Damjan et al. | |
| 7,815,187 | B2 | 10/2010 | Yokota | |
| 10,140,806 | B2 | 11/2018 | Pececnik | |
| 10,522,000 | B2 * | 12/2019 | Pececnik | G07F 17/3244 |
| 10,733,855 | B2 * | 8/2020 | Loderer | E05B 69/006 |
| 2004/0087357 | A1 * | 5/2004 | Johnson | G07F 17/3223 463/17 |

(Continued)

*Primary Examiner* — Jay Trent Liddle
*Assistant Examiner* — Ryan Hsu
(74) *Attorney, Agent, or Firm* — BakerHostetler

(57) ABSTRACT

A roulette system provides an enhanced gaming experience with:

a) a wheel assembly of a bowl accommodating a roulette ball and an inner diameter of the wheel assembly;

b) raised deflection elements are disposed within an annular lower track; and c) at least 37 randomly numbered receptors are on the wheel. Attached to the wheel assembly above the upper track is a panel of multicolor light elements with a direction of light emission of individual light emitting elements in the light panel oriented to direct emitted light towards the receptors, the panel circumscribing the bowl and providing at least two different color light elements. At least some of the multicolor light emitting elements varying individual light intensity of individual ones of the multicolor light emitting elements to variably color the wheel assembly. An audio system also replicates gaming sounds of roulette.

20 Claims, 6 Drawing Sheets

(56) References Cited

U.S. PATENT DOCUMENTS

| | | | | |
|---|---|---|---|---|
| 2005/0009607 | A1* | 1/2005 | Russell | G07F 17/32 463/42 |
| 2005/0282618 | A1 | 12/2005 | O'Halloran | |
| 2006/0055109 | A1 | 3/2006 | Yokota et al. | |
| 2008/0090640 | A1 | 4/2008 | Okada | |
| 2008/0113706 | A1 | 5/2008 | O'Halloran | |
| 2008/0280679 | A1 | 11/2008 | Beaupre | |
| 2009/0275411 | A1 | 11/2009 | Kisenwether et al. | |
| 2010/0041464 | A1 | 2/2010 | Arezina et al. | |
| 2012/0083331 | A1 | 4/2012 | Carpenter et al. | |
| 2012/0122571 | A1 | 5/2012 | Desimone et al. | |
| 2012/0175840 | A1 | 7/2012 | Zerga | |
| 2014/0342825 | A1 | 11/2014 | Schrementi et al. | |
| 2015/0024818 | A1 | 1/2015 | Chun | |
| 2016/0054966 | A1* | 2/2016 | Dinning | A63F 13/52 463/17 |

* cited by examiner 100
102
104
106
108
118
120
122
116

ACTIVE PLAYER CONTROLS FOR GAMING APPARATUS

CROSS REFERENCE TO RELATED APPLICATIONS

This application is a continuation of U.S. patent application Ser. No. 15/295,047, filed Oct. 17, 2016, the contents of which is incorporated herein by reference in its entirety.

BACKGROUND OF THE INVENTION

1. Field of the Invention

The present invention relates to the field of gaming, particularly the field of roulette or craps gaming, and more particularly to the field of group gaming play as in a pit or arena.

2. Background of the Art

Roulette and craps are the most successful large table games that allow for large numbers (e.g., more than 8) of players at a single table. Card games and even big wheel have even less available space for players. Even with automated systems for these large area table games (specifically craps and preferably roulette), it would be more efficient to have players in the casino interact with the games. The use of hand-held devices has not proved to provide the quality and ambience of group play that is a desirable aspect of these large-table games.

Numerous systems have been used to automate games to speed up play and remove table personnel to increase revenues. The following descriptions some of include those technical advances in large-table gaming systems.

Published US Patent Application Serial No. 20050282618 (O'Halloran) discloses a gaming machine system for a communal slot machine game. The system includes processing means for determining a result of a slot machine game, a communal display device (1) for displaying the result and a plurality of terminals (2-11) linked via communication means to the processing means. A number of the terminals (2-6) are physically located proximate the communal display device (1) so that players of these terminals can see the result on the communal display device (1). A number of the terminals are located remote from the communal display device (1). These remote terminals (7-11) are provided with individual displays to allow respective players to see the result. In playing a communal slot machine game with the system, the outcome at each of the terminals is solely dependent on the single, communal result determined by the processing means.

Published US Patent Application Serial No. 2008011376 (O'Halloran) discloses a gaming table is used with the at least one game piece to determine a random outcome. At least two player interface wagering systems with a visual display are provided on each player interface wagering system. Each player interface wagering system is in communication link with a game server that processes game data and determines wager outcomes. Each player interface wagering system has at least two selectable wagering input displays that may be separately selected and displayed by a player wagering at each player interface. Each of the at least two selectable wagering input displays identifies different sets of wagers that may be placed by the player on the random outcomes of the wagering game.

Other gaming systems, mainly employing limited range of visibility (for example 180 degree viewing angle) systems such as forward screens or top boxes.

Published US Patent Application Serial No. 20150024818 (Chun) describes an electronic gaming table for hosting live table games involving wagers can include a physical surface, a dealer station, a plurality of player terminals, and a table controller. The physical surface permits the play of live table games with a live dealer and physical game components. The dealer station is situated proximate the physical surface and allows the presence of a live dealer who facilitates game play. Player terminals allow live players to play the games and include player terminal processors coupled to player interfaces having input and output devices. A table controller coupled to the player terminals controls various table functions and administers a live table game pitting a first hand against a second hand. Each of multiple live players can make different live game decisions independently based upon the same second hand, wherein resolution of the game varies by player depending upon the different live game decisions.

Published US Patent Application Serial No. 20140342825 (Schrementi) discloses a system and apparatus for mounting an overhead display device to gaming machines. The system and apparatus featuring mounting elements securable to a display device at a selected distance and mounting hardpoints on one or a plurality of gaming machines. The hardpoints having a recess with a size and shape corresponding to that of the mounting elements. Wherein the display is securable to gaming machines in an overhead configuration when the mounting elements are secured to hardpoints and where the distance between the mounting elements corresponds to the distance between the hardpoints to which they are respectively secured.

Published US Patent Application Serial No. 20120122571 (DeSimone) discloses a top box wheel assembly and method wherein a flat panel display is mounted on a rectangular shaped cabinet top box structure and a circular bezel structure overlays the flat panel display such that a wheel-shaped display area is provided. The circular bezel structure also is shown to include a rectangular cutout base to also provide a rectangular-shaped display area. The circular bezel structure is further shown to include a circular pattern of LEDs which may be operated synchronously or quasi-synchronously with the wheel-shaped display area on which a rotating wheel may be displayed together with an indicator.

Published US Patent Application Serial No. 20120083331 (Carpenter) discloses a convertible in-revenue and out-of-revenue gaming system is disclosed that includes a server connected to automatically convert operating modes and control in-revenue and out-of-revenue operation of one or more banks of gaming machines. Additionally disclosed are gaming machines with video cameras connected to provide live video feed to one or more displays, such as during tournament play when live video feed of the players and the player tournament positions may be driven in real-time to an overhead display by the server operating in a tournament controller mode.

Published US Patent Application Serial No. 20010041464 (Arezina) discloses a gaming system for playing a wagering game is provided which includes a plurality of gaming machines (10a-10f) configured to play a wagering game and to participate in a community-event. A movable member (99) is disposed substantially adjacent to the plurality of gaming machines and is configured to move relative to the plurality of gaining machines from a first position to a second position during a community-event (S500) in response to a single triggering event (S505). The movable member is moved relative to the plurality of gaming machines during a community-event to reveal at least one community-event outcome for the community-event (S510).

Published US Patent Application Serial No. 20090275411 (Kisenwether) discloses techniques described for providing group play bonus events with multiple game devices. A group play bonus event is initiated based in part on the occurrence of a group play bonus event trigger. End users of game devices participate in an initiated group play bonus event if the end users qualify to participate in the group play bonus event at the time of the occurrence of the group play bonus event trigger. In some situations, group play bonus events are initiated by the occurrence of a randomly generated group play bonus event trigger.

U.S. Pat. No. 9,183,695 (Allen) discloses techniques for controlling wagering game environments. In one embodiment, a computer-implemented method for controlling a casino wagering game environment includes determining a plurality of zones in the casino wagering game environment, wherein the zones include one or more wagering game machines. The method can also include presenting wagering games on the wagering game machines in the wagering game environment, and detecting an event in the wagering game environment, the event triggering a bonus game for which a plurality of players have a possibility of winning an award. The method can also include determining one or more of the zones in which to present media associated with the bonus game, and presenting, in the one or more zones, the media associated with the bonus game. The method can also include determining a winner of the bonus game, and providing the award to the winner.

Published US Patent Application Document No. 20080280679 (Beaupre) describes methods and systems for providing improved audio environments in relation with gaming systems. According to one embodiment, a gaming system comprises a gaming device comprising sound producing components and a sound processing system for transmitting sounds to a player based on sounds produced by the components. The sound processing system comprises a microphone; filtering means filtering the audio signal resulting from the sound capture; and outputting means outputting an audio environment based on the filtered signal. Therefore, the system provides, in real time or with a non-perceivable delay, an improved audio environment reflecting an outcome generation process. In another embodiment, a method is described comprising the steps of capturing outcome generating sounds in a signal, filtering it, and outputting an audio environment accordingly, wherein the method is performed in real time or with an non-perceivable delay. A particular embodiment is an automatic roulette device performing the present method.

U.S. Pat. No. 4,337,945 (LEVY) discloses a gaming apparatus in which a roulette wheel has a circular rim and a downwardly converging frustoconical bowl contained within the rim and joined thereto forming a track therewith for a roulette ball and a rotatable wheel head centered within the bowl at the bottom thereof and formed with a plurality of numbered compartments for receiving the roulette ball. An automatic roulette ball spinner having at least one guide tube is positioned along the rim for directing the roulette ball onto the track and is provided with a powered plunger for propelling the roulette ball through the guide tube. The guide tube is vertically moveable for lowering it onto the track to discharge the ball and then raising it to allow the ball to travel around the track uninterruptedly.

The above technologies may be incorporated into the practices of the present invention and all documents cited herein are incorporated by reference in their entirety.

U.S. Pat. No. 7,094,150 (Ungaro) discloses an improved roulette game utilizing he existing roulette wheel and/or electronic LED wheel with an existing layout to enhance the game or roulette. Players make wagers on the conventional layout and using the plurality of token or chip acceptors as an extra wager to win either a major progressive jackpot or minor progressive jackpot.

U.S. Pat. No. 4,260,159 (Hoffman) describes an electronic game simulating a roulette wheel whereby 38 light emitting diodes are circularly disposed. The diodes are sequentially illuminated so that a light appears to move circularly. A pulse generator, including a voltage controlled oscillator, activates a 4-by-10 matrix counter to sequentially light said diodes. A discharging capacitor controls the length of time the pulses are generated. A speaker coupled to the pulse generator simulates the sound of the ball hopping on the roulette wheel.

SUMMARY OF THE INVENTION

A roulette system provides an enhanced gaming experience with:

a) a wheel assembly of a bowl accommodating a roulette ball and an inner diameter of the wheel assembly;
b) raised deflection elements are disposed within an annular lower track; and
c) at least 37 randomly numbered receptors are on the wheel.

Attached to the wheel assembly above the upper track is a panel of multicolor light elements with a direction of light emission of individual light emitting elements in the light panel oriented to direct emitted light towards the receptors, the panel circumscribing the bowl and providing at least two different color light elements. At least some of the multicolor light emitting elements varying individual light intensity of individual ones of the multicolor light emitting elements to variably color the wheel assembly. An audio system also replicates gaming sounds of roulette.

DETAILED DESCRIPTION OF THE INVENTION

Figure 1:
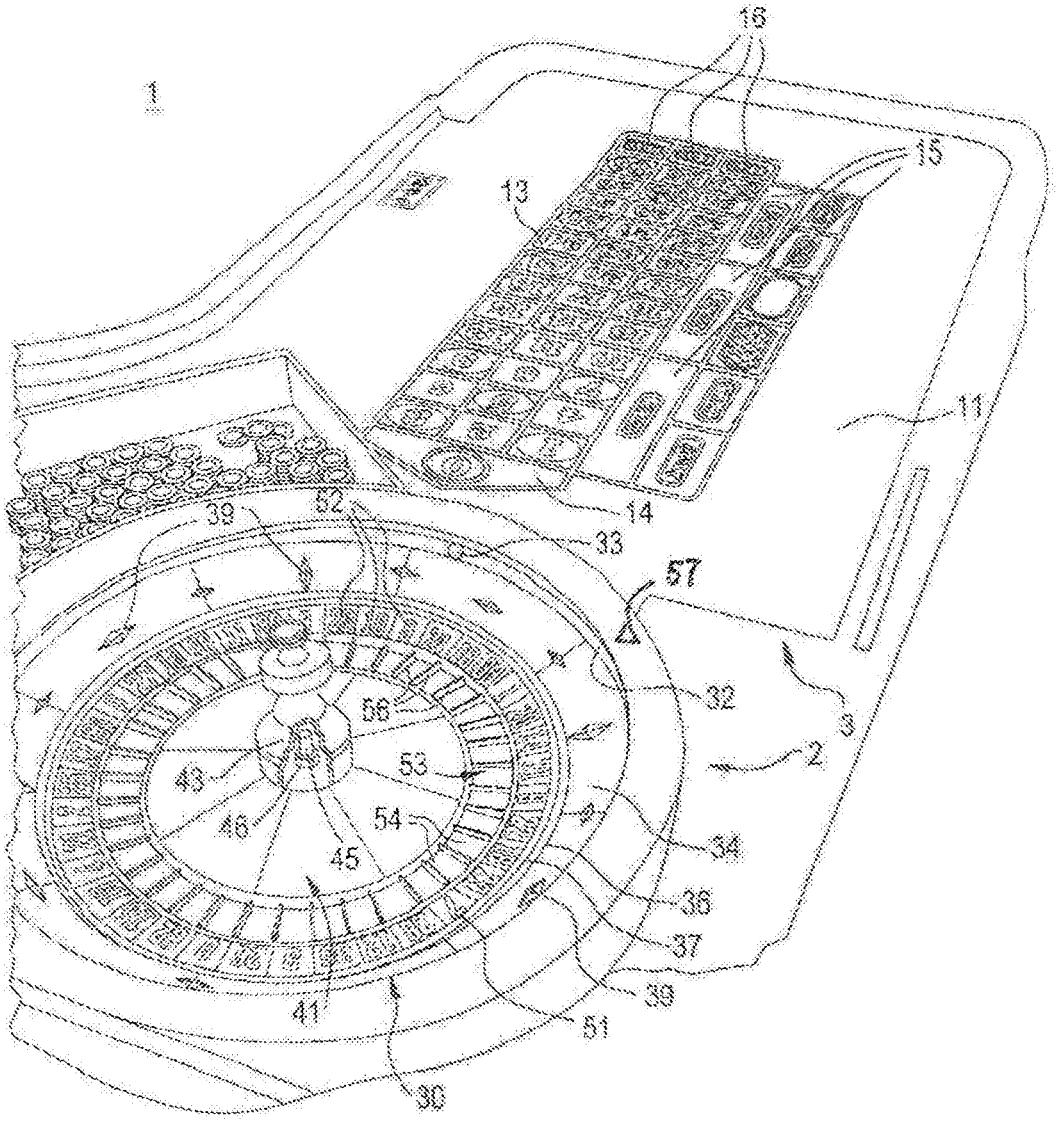
FIG. 1 is a axonometric view of a roulette wheel which may incorporate the present invention.

An enhanced roulette system that provides increased visual or visual and audial entertainment may include:

a) a wheel assembly comprising a bowl with a circular upper track for accommodating a roulette ball, the upper track surrounds an annular lower track which meets the upper track at a lower end of a circumference of the upper track and slopes downwardly toward an inner diameter of the wheel assembly;

b) raised deflection elements are disposed within the annular lower track; and c) at least 37 randomly numbered receptors having thirty-seven individual numbers between 0-36 distributed among the 37 randomly numbered receptors. The above elements are intended to include standard physical roulette tables so that retrofitting of the existing systems can be done with the least expense of manufacture. Original systems and tables can of course be constructed, but in the tight competitive gaming market of today, the ability to reduce costs can be significant.

Attached to the wheel assembly can be the components necessary to implement the present invention. For example, above (or below, although this requires more precise and less dimensionally and weight tolerant constructions and components) the upper track is a panel, strip, set or array (generically referred to herein as a "panel") of multicolor light emitting elements with a direction of light emission of individual light emitting elements in the light panel oriented to direct emitted light towards the receptors, the panel circumscribing the bowl and providing at least two different color light elements, wherein at least during rotation of the wheel assembly, at least some of the multicolor light emitting elements varying individual light intensity of individual ones of the multicolor light emitting elements to variably color the wheel assembly. The light emitting elements are preferably provided in a format and location and construction where they will be unlikely or impossible to interact with the flight or spin of the roulette ball. The panel is preferably tilted and or separated away from the ball track to avoid such interference.

The roulette system may provide the multiple light emitting elements as at least three, at least four and at least five distinctly colored light emitting elements. By having multiple colors, and by proper selection of light colors (with bulbs, filters, LED emitters, etc.), the lights can be provided to match times of day, casino theme colors, holiday colors (e.g., red and green for Christmas, green and white and orange for St. Patrick's Day, red, white and blue for US Holidays, etc.) and other aesthetic controls. The roulette system may have at least 70%, at least 80% and at least 90% of the light emission from the multicolor light emitting elements is emitted at an angle that is lower than that towards a top portion of the wheel assembly opposite to a location of individual multicolor light emitting elements. In this way the light is emitted primarily towards the wheel and numbers, and is not shone into the players' or any casino personnel's eyes. Substantially all of the light (99-100%) may be so directed as light will be reflected off the wheel to display the colorizing event and avoid incidental issues with players.

The roulette system may provide at least some of the multicolor light emitting elements as light emitting diodes, preferably disposed on a single support strip circumscribing the wheel assembly. A single support strip may be easily removed and replaced and LED emitters are low energy consumers. The single support strip may have pins or snaps that will engage the structure adjacent the wheel itself, so that any replacement will not affect the spin or alignment of the wheel.

The roulette system may further include an audio system that is configured to automatically emit audio recordings or amplified sounds of at least a roulette ball striking deflection elements on a roulette wheel after rotation speed of the wheel during a roulette gaming event has reached a minimum speed. There may be speed or motion sensors on the system (either under the wheel or above the wheel) that senses the speed and motion of the wheel, and the sensor can then initiate both the light effect and simultaneously or at a different time, initiate the audio effect. For example, the light effect may be initiated immediately upon spinning the wheel (and cease after ball drop, at a specific speed limit reached after deceleration, or when the wheel stops), and the audio effects start and/or change at sensed speeds. For example, the audio effects may begin only when the ball is spun (to provide the amplified sound of the ball rolling on the ball track), or when the speed decelerates to a speed approximately corresponding to a time frame when the ball may be striking the deflectors and the ridges adjacent the numbers towards the center of the wheel. The sensors may be geared to the wheel or be IR, UV, visual light, or acoustic sensors directed at the wheel. The sounds may be prerecorded and stored for broadcast, or the actual sounds may be amplified. The latter has some aesthetic benefits, but secondary noise filters would be useful to prevent background noise and player communication for being broadcast.

The roulette system may provide an the audio system having multiple speakers distributed around the wheel assembly, and the automatic audio emission simulates a changing physical location of a ball on the wheel assembly by varying intensity of sound from the multiple speakers so that sounds of different volumes are sequentially emitted from each speaker. This can be done by sequencing volume output from each consecutive speaker and balancing the sound location, as with quadraphonic speaker systems. For example, with four consecutive speakers distributed about the wheel (again, in no way interfering with the wheel movement) and nominally identified in order as speakers A, B, C and D, sound could be created to appear as if coming from the quadrant with speaker A by having power input to each speaker as (A—100%, B and D—40% and C—0%). As the ball moves, the power levels shift so that when implying a ball location at C, the power distribution could be A—0%, B and D—40% and C—100%). This can be represented as providing power levels to indicate a ball position at speaker A as A power>B and D power>>C power.

The roulette system may be an automated gaming system wherein the system is configured to mechanically impart ball movement and wheel rotation without manual effort, and after imparting of ball movement and wheel rotation, the panel of multicolor light emitting elements automatically has individual ones of the multicolor light emitting elements alter light emission intensity. Such automated systems, without the benefits of the present invention, are recognized in the art as shown by U.S. Pat. No. 4,337,945 (LEVY).

A method of executing a wagering event outcome on a roulette wheel system may include:

a) a wheel assembly comprising a bowl with a circular upper track for accommodating a roulette ball, the upper track surrounds an annular lower track which meets the upper track at a lower end of a circumference of the upper track and slopes downwardly toward an inner diameter of the wheel assembly;

b) raised deflection elements are disposed within the annular lower track;

c) at least 37 randomly numbered receptors having thirty-seven individual numbers between 0-36 distributed among the 37 randomly numbered receptors; and wherein attached to the wheel assembly above the upper track is a panel of multicolor light elements with a direction of light emission of individual light emitting elements in the light panel oriented to direct emitted light towards the receptors, the panel circumscribing the bowl and providing at least two different color light elements, wherein at least during rotation of the wheel assembly, at least some of the multicolor light emitting elements varying individual light intensity of individual ones of the multicolor light emitting elements to variably color the wheel assembly;

wherein the method comprises rotating the wheel in a first direction of rotation and spinning a roulette ball within the upper track in a second direction of rotation opposite that of the rotating wheel, and causing at least some of the multicolor lights to vary in individual light intensity during at least a period of time while the roulette wheel is rotating and the ball is spinning.

The method may include using at least three different colors of multicolor light emitting elements and variation in individual light intensity requires at least some of the individual multicolor light emitting elements to turn on and off during rotation of the wheel and spinning of the ball, and the roulette wheel assembly may further include an audio system that is configured to automatically emit audio recordings or amplified sounds of at least i) a roulette ball striking deflection elements on a roulette wheel after rotation speed of the wheel during a roulette gaming event has reached a minimum speed or ii) a sound of a ball rolling within the circular upper track, and during the rotation of the wheel and spinning of the ball, the audio system, automatically emit audio recordings or amplified sounds of at least i) a roulette ball striking deflection elements on a roulette wheel or ii) a sound of a ball rolling within the circular upper track. As noted earlier, a sensor may determines rotation speed of the wheel and the audio system emits sounds dependent upon sensed speed of the wheel.

FIG. 1 is a perspective view of a roulette table 1 including a wheel assembly 2 and a field 3. Customarily, the field 3 is formed on a green felt flat surface 11. The current embodiment is illustrated as a French wheel having a field 3 with number grid 13 labeled with the integers 1-36 and a zero grid 14 containing a single zero. An American wheel will also display a 00 green canoe to increase house hold in the gaming event. Additionally, outlaying areas 15 and 16 are provided for placing bets on groups of twelve or eighteen numbers.

The wheel assembly comprises a bowl 30 comprising a circular upper track 32 for accommodating a roulette ball 33 shown in motion in the track 32. The track surrounds an annular lower track 34, which meets the upper track 32 at a lower end of its circumference and slopes downwardly toward an inner diameter 36.

The inner diameter 36 surrounds a circular recess 37. Aligned on a circle roughly at the radial midpoint of the lower track 34 are located "canoes" 39. Conventionally, there are eight canoes 39 which are "diamond shaped," being nearly rhomboidal parallelograms. The canoes 39 are equally angularly spaced and alternate between a radial orientation and a tangential orientation with respect to the circle on which the centers of the canoes lie. The circular recess 37 receives a wheel 41. A turret 43 projects upwardly from the center of the wheel 41. The turret 43 is shown partially broken away to illustrate a shaft 45 projecting from the bowl 30. The wheel 41 includes a central bearing 46 which receives the shaft 45 and rotates on the shaft 45.

The wheel 41 comprises an outer radial ring 51 including outwardly facing numbers 52, corresponding to the numbers in the field 3. Radially and inwardly of the outer ring 51 is a pocket ring 53 comprising one pocket 54 in registration with each outwardly facing number 52. Each pocket 54 is separated from the next pocket 54 by a fret 56. "Fret" is the term in the art for a separator between pockets. In operation, a dealer or automatic ball release system imparts velocity to the ball 33 such that centrifugal force maintains the ball 33 in the track 32 for at least a preselected number of revolutions about the wheel 41. At the same time, the dealer pushes the one of the frets 56 to spin the wheel 41 in a counter-clockwise direction. Once the ball 33 begins to be drawn by gravity toward the wheel 41, the ball continues on an approximately spiral path and eventually reaches the wheel. It may hit one of the canoes 39. It may bounce after hitting the wheel 41 or on of the frets 56 and eventually rests in a pocket 54. The number 52 corresponding to the pocket 54 is the "winner" and payoffs and loses are determined accordingly.

Figure 2:
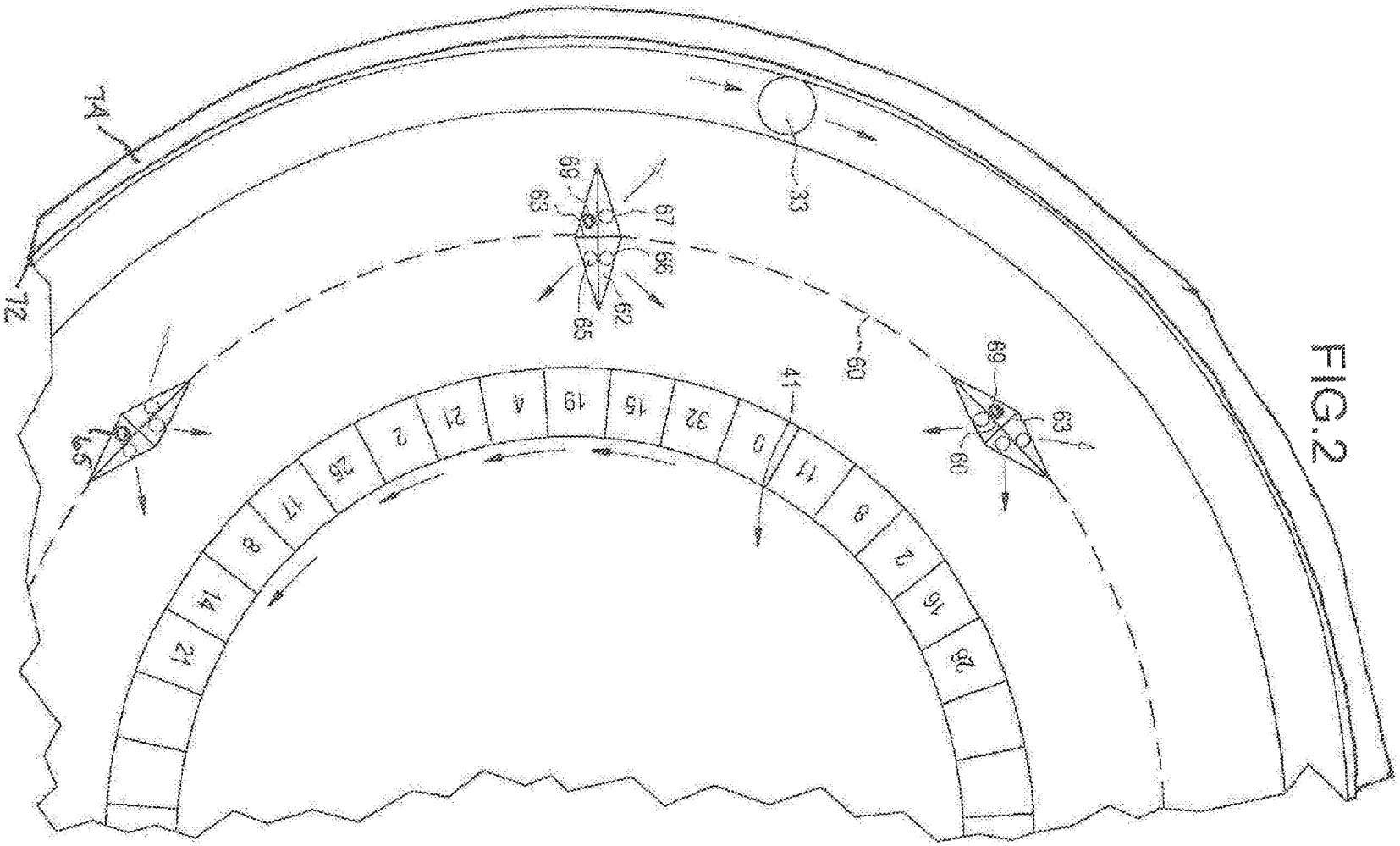
FIG. 2 is a partial detailed view further illustrating positioning of canoes in a lower track.

The canoes are further explained with respect to FIGS. 2, 3 and 4 which are respectively a partial detailed view of FIG. 1, and a plan, partially broken away, and an elevation of a canoe 39. In the various drawings, the same reference numerals are used to denote the same components. As seen in FIG. 2, the canoes (randomizing elements) 39 lie on a circle 60. Alternate canoes 39 have a long axis 62 substantially radial with respect to the circle 60 and the remaining canoes have the long axis 62 substantially tangential to the circle 60. The facet shape of the bounce elements is not a true facet in that it is not planar. However, the surface of the canoe 39 is described as having facets because the surface of the canoe 39 generally faces in four directions.

In one particular example of the canoe 39, the length of the long axis 62 is between 4.6 and 7.0 cm (e.g., 5.2 cm). The bounce points 65, 66, 67 and 69 have their centers approximately 0.3 cm above the surface of the lower track 34. They are also approximately 0.6 cm from the short axis 63 of the canoe 39. The numbers determining outcomes are disposed in catches (alternatively known in the art as the receptors/slots/compartments/pockets above areas displaying the numbers) towards the lower portion of the wheel.

Figures 3A, 3B:
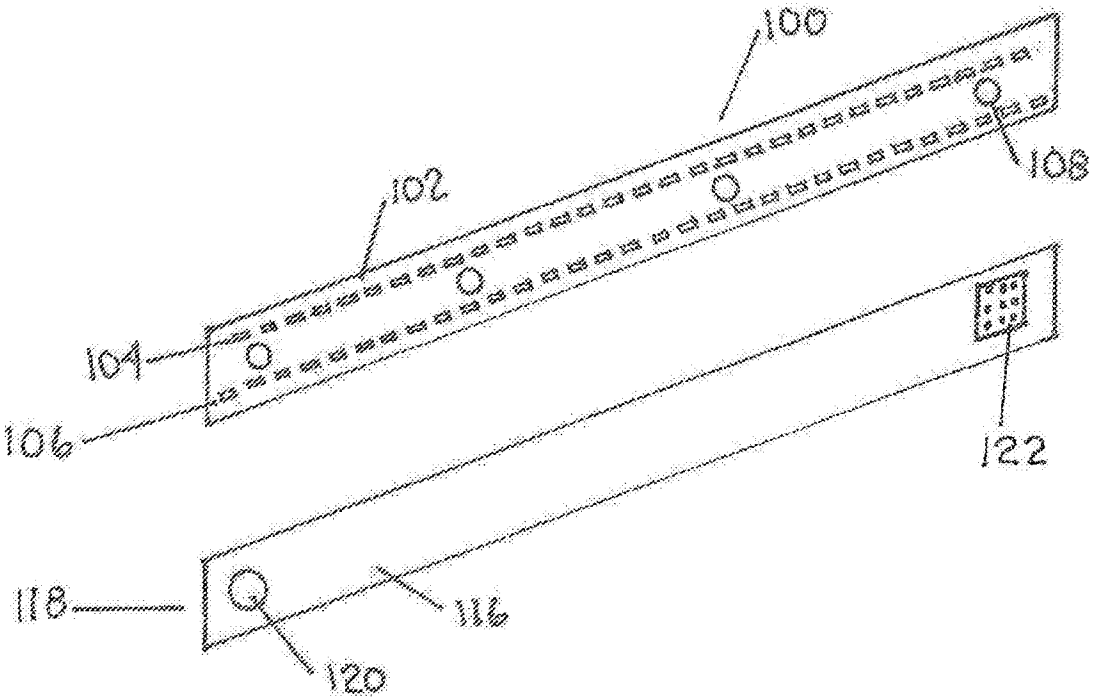
FIG. 3A is a perspective view further illustrating a front face of a strip for positioning of light-enhancing elements distributed above the ball-running track and above canoes in a lower track.
FIG. 3B is a perspective view further illustrating a back face of the strip of FIG. 3A for positioning of light-enhancing elements distributed above the ball-running track and above canoes in a lower track.

A bridge area 72 is shown between the ball movement 33 and the multicolor light emitting strip 74, This strip 74 is shown in greater detail in FIGS. 3A and 3B.

FIG. 3A is a perspective view further illustrating a front face of a strip 100 for positioning of two rows 104 106 of multicolor light-enhancing elements, with the strip 100 distributed above the ball-running track and above canoes in a lower track. A series of four speakers 108 are also shown. This face 102 of the strip 100 would be positioned so that the rows of lights 104 106 would project towards the numbers on a centrally located roulette wheel. The strip 100 would be curved to be flush with the surface in FIG. 2 that supports the panel 74 in FIG. 2.

FIG. 3B is a perspective view further illustrating a back face 118 of the strip of FIG. 3A for positioning of light-enhancing elements distributed above the ball-running track and above canoes in a lower track. A single snap contact 120 for engaging the strip 118 to electronics in the wheel system and a pin connector 122 are shown. To change or replace lights in the roulette systems, these or other snap or pin connections would be removed and a new strip 118 connected. The face 116 of the back of the strip 118 would be curved to be flush with the surface in FIG. 2 that supports the panel 74 in FIG. 2.

It would be preferred to have at least two different color individual light emitting elements for each number (e.g., at least 74 for a French wheel or 76 emitters for an American wheel) so that more than single colors are available for each number, and that colors may be effectively dedicated to each number area as the wheel rotates. It is more preferable that there be at least three individual different color light emitting elements be available for each number position (e.g., at least 111 for a French wheel or 114 emitters for an American wheel).

In higher end roulette wheel systems, the sensors (e.g., 57 in FIG. 1) placed here above the ball track 32 would be able to indicate the speed rotation of the wheel and even location of each number 52 with respect to the light emitting elements and even sets of light emitting elements. The flashing of the multicolor light emitting lights can then be timed (especially at slower speeds) to flash the desired color directly at individual numbers 52 to further enhance to display effect.

A processor (not shown) would be embedded in or in a communication link with the strip 100 to control light patterns, light emitter combinations, sound emissions, sound track storage and the like. A power source (not shown) should also be available for all of the processor, light emitting elements and speaker. Volume controls (not shown) may also be desirably available for the pit crew to use so that volumes appropriate to background noise levels and the desires of players can be input.

A unit that can retrofit into existing tables can be provided such as a drop-in unit of the processor, power supply/source, speakers, light panel, and roulette wheel can be added to older tables to upgrade them.

The present inventive technology can provide an excellent enhancement for the inventor's copending U.S. patent application Ser. No. 15/206,269 filed 9 Jul. 2016 and titled WIDE AREA ROULETTE DISPLAY SYSTEM WITH GROUP ARENA PLAY. Other variations and additions may be provided and remain within the scope of the present invention. That copending US Patent Application and every other document cited herein is incorporated by reference in its entirety herein. That wide area roulette display is illustrated by FIGS. 1B, 2A and 2B.

Figure 1B:
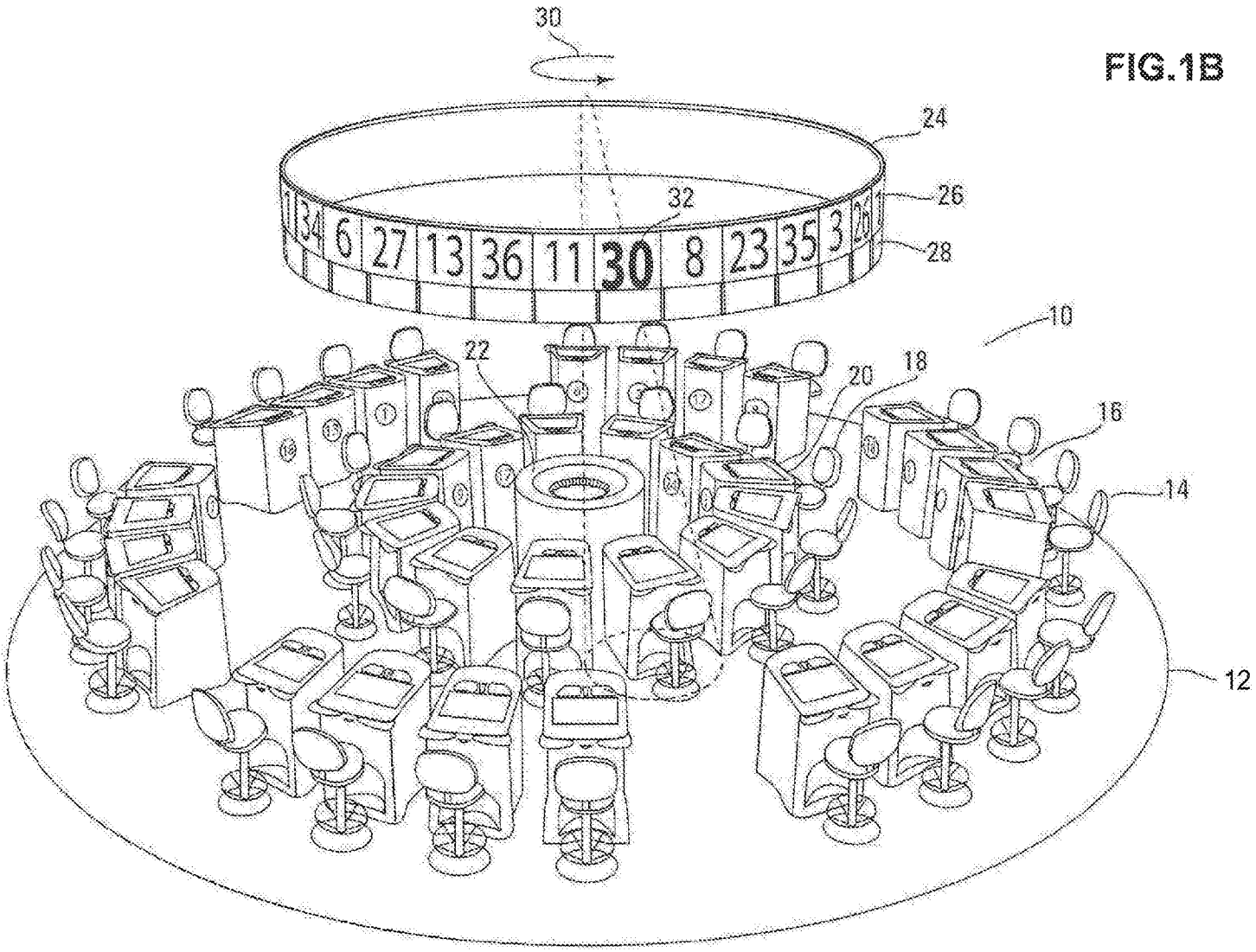
FIG. 1B shows a perspective view of an automatic gaming system within the scope of the present invention.
Figure 2A:
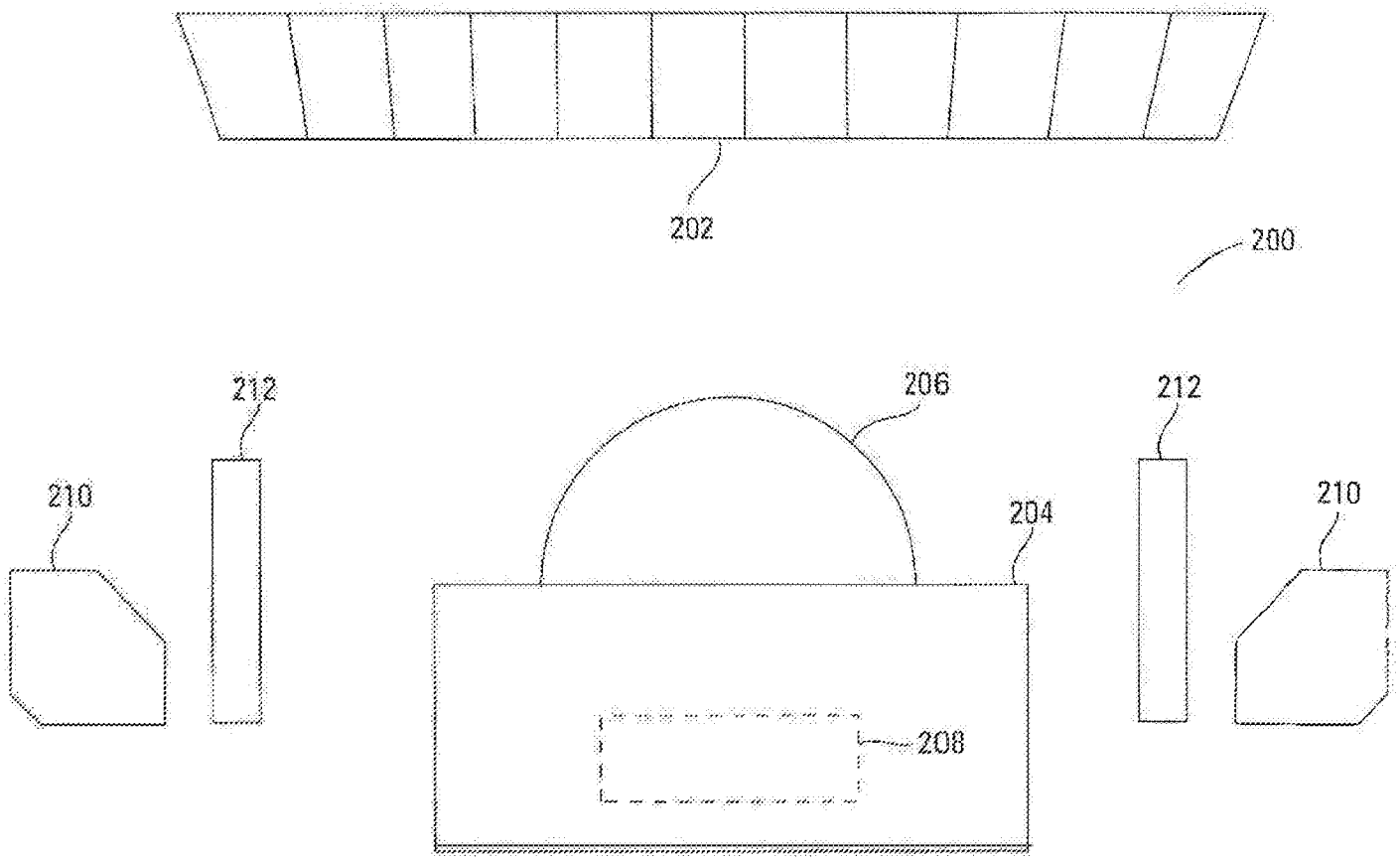
FIG. 2A shows a side view of an automatic gaming system within the scope of the present invention.

FIG. 1B shows a perspective view of an automatic gaming system 10 within the scope of the present invention. The automatic gaming system 10 is shown with an arena area floor 12 (which may be flat, sloped or in multiple levels with steps) having an outer ring of players' chairs 14 and associated outer ring of player input terminals 16. There is also an inner ring of players' chairs 18 with their own associated inner ring of player input terminals 20. Approximately central within the inner and outer rings of terminals 16 and 20 is a roulette wheel and ball drop 22 which is preferably automated but may be manually operated. Above the roulette wheel and ball drop 22 is an elevated display system 24 (also referred to herein as an overhead, centrally positioned display unit) which is designed to be able to display roulette gaming data at least to the outer ring of players' chairs 14 and preferably also to the inner ring of players' chairs 18. The overhead, centrally positioned display unit 24 may have a single set of display panels 26 as individual panels or as a continuous display screen, or may have two sets of display panels 26 and 28 for informational display. To assist the inner circle players to see the display of results, the lower panel 28 may be tilted more towards the floor 12 to offer a better angle of view of the lower panel 28 to the inner circle of players' chairs 18.

The information displayed on the one 26 or two 26 and 28 panels should include at least a display of the final results of the roulette ball drop event, further preferably presented as the complete set or nearly complete set of available colors and numbers in a roulette wheel (as partially shown in element 26). The entire display 24 may physically rotate (as shown by direction arrow 30 showing a counterclockwise rotation) when viewed from above (it may be clockwise also) or may virtually rotate by having the image display on the one 26 or two panels 26 and 28 present a virtual spinning wheel and associated ball drop. The ball drop event should be significantly highlighted in the display 26. The outcome number for the ball dropping on number 30 on the wheel is shown as element 32, with a virtual translucent ball or color, or expanded image or flashing image being overlaid onto the number 30. The size of the number 30 may be increased (e.g., shrinking other adjacent frames to make room for the larger 30, or by having the number 30 extend into the lower panels 28. Once the final outcome has been determined (in this case number 30 and its associated color), the entire lower set of panels 28 may display only the number 30, with its color also shown or the color shown separately. The reading of the actual outcome and its display on the overhead, centrally positioned display unit 24 should have as small a time gap between outcome and display as possible, even approaching actual real-time display. The overhead, centrally positioned display unit may also have speakers therein (not shown) so that audio signals and announcements of the results can be provided to assist the hearing impaired or just for additional entertainment value. Reference to the additional following Figures will assist in additional understanding of the present invention.

Figure 2B:
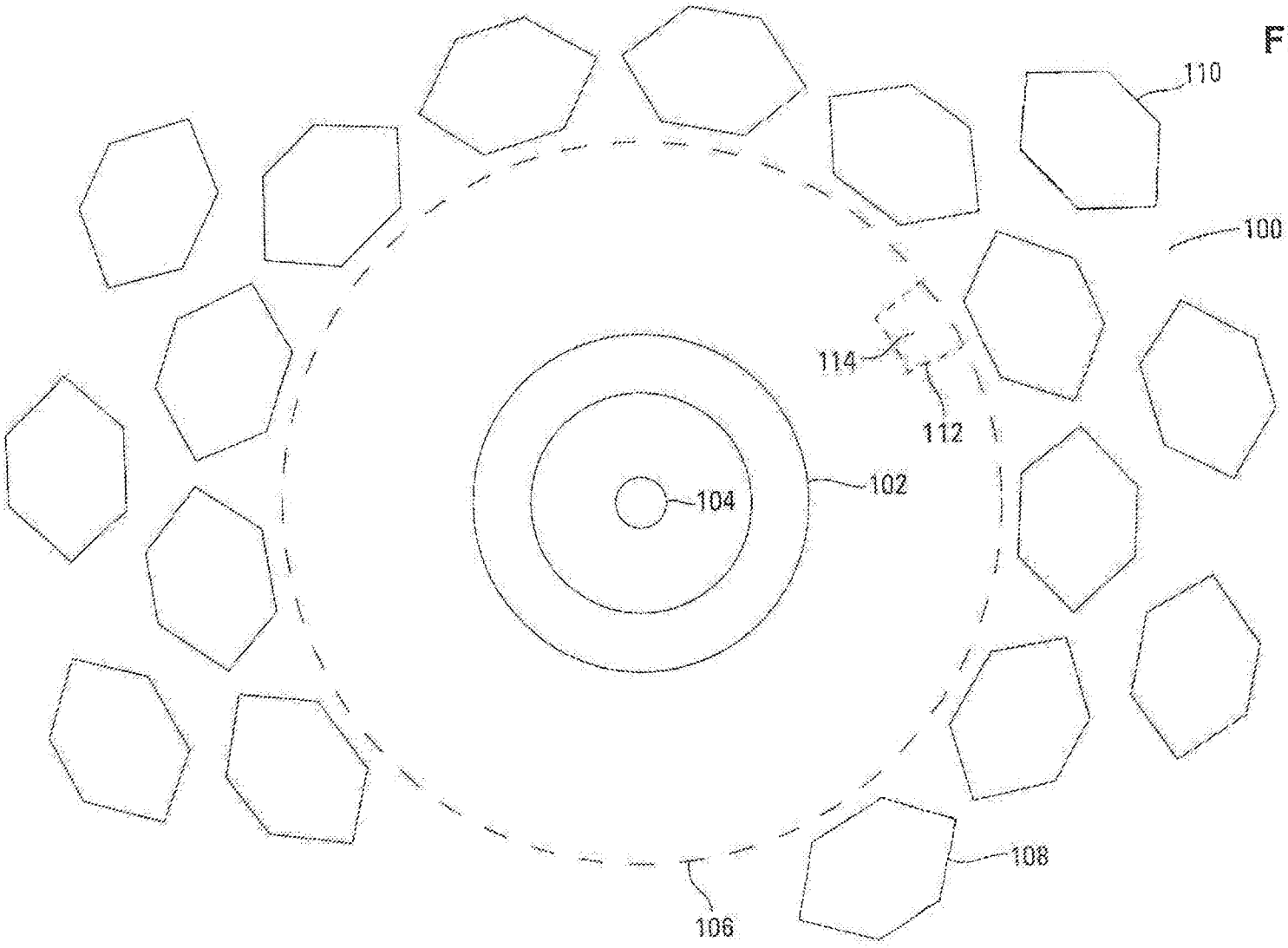
FIG. 2B shows a top view of an automatic gaming system within the scope of the present invention.

FIG. 2B shows a top view of one embodiment of the present technology. A gaming system 100 is shown with a fully automatic roulette assembly 102 in which there is a central processing unit 104. A top cover and display component 106, is positioned above the automatic roulette system 102. From this top view, it cannot be fully appreciated that the top cover and display component 106 is elevated above the automatic roulette system 102 and positioned high enough and centrally enough to be viewable by both an inner ring 108 of player wagering terminals and an outer ring 110 of player input terminals. Each of these terminals will be in communication (hard-wired or wireless linkage) with the central processing unit 104, and will have a display screen and player input components (buttons, touchscreen, voice recognition, and/or the like). The processor will be in two-way communication with the fully automatic roulette system 102 to both place wagers, and receive game event outcomes from the automatic roulette 102 system that are communicated back to the two rings 108 110 of player terminals to implement wagering outcomes.

FIG. 2B shows a side view of a wide area gaming system 200 according to one embodiment of the invention. A fully automatic gaming system 204 (for enabling craps or roulette gaming events) is shown with a fully enclosing transparent bubble cover 206 and a central processor 206. The automatic gaming system 204 is shown in a central location with respect to individual player seats 210 and input terminals 212. The processor transmits gaming outcome content to both the individual player terminals 212 and to the overhead, centrally positioned display unit 202 having a display perimeter 214. The display perimeter 214 may be continuous screen, connected screen segments or independent screen segments capable of displaying game outcome effects, For example, using roulette gaming events for purposes of illustration, the display perimeter may have individual segments or the continuous field simulate the canoes/slots on a roulette wheel with the numbers of the wheel being displayed, in rotational mode for example, with virtual speed varying to simulate speed variations on a physical roulette wheel. The virtual appearance of a drop ball may be overlaid on the screens, and when the actual ball drop occurs, the virtual ball is shown as an image on the screen on the event outcome number (e.g., a white ball over the number or a white translucent number over the number so that it is viewable through the ball. The virtual wheel on the overhead display 202 and the individual segment 214 may rotate slowly (mimicking a physical roulette wheel) and/or may stop completely and every segment (viewable by an array of surrounding player stations, chairs and terminals) can be either the entire wheel displayed with the one winning outcome displayed or the single winning outcome can be displayed distributed around the entire circumference of the overhead display 202. The same white ball on number symbol may be displayed in all or some of the segments to assure ease of viewing the outcome from each and every player terminal.

As shown in FIG. 2A, the display surface 216 may be sloped to provide a better angle of vision 218 to nearest arrays of player seating 210 in front of the player input terminals 212. The line of sight between outer arrays of player input terminals (not shown in FIG. 2A, but see 110 in FIG. 2) would be even a larger angle away from horizontal between a center of the overhead display 202 and a center of the automatic gaming system 204. The outer array of player input terminals 110 (FIG. 2) may be on a same horizontal surface as the inner array 108, or may be on a higher surface (forming a pit with the automatic gaming system 102 204 on the lowest level), and/or may be on a lower level (placing the automatic gaming system 102 204 on a mound position elevated above at least some outer player input terminals 110).

The above described generic invention may include additional and alternative features within the scope of the present technology. For example, the bubble cover 206 may include a holographic display system for the outcomes, with suspended particles in the interior of the transparent/translucent bubble cover 206 supporting laser projected holographic images of the outcomes and/or wheels. Alternatively, the interior surface of the bubble may have light absorbing characteristics that would support light displays on the surface of the bubble cover 206. The overhead display or environmental acoustics can support a sound system (speakers) so that in addition to the visual overhead display, an audio announcement of game outcomes can be provided.

Alternative terminals, alternative automated craps and roulette systems within the total system of the present invention may also be used. The Overhead display system may also indicate (in addition to the single number/color output random event) specific other wagering outcomes. For example, if a player has made a wager on side bets with repeated numbers, consecutive numbers, consecutive colors, etc., either the same line/circumference of displayed wagers on the display perimeter 214 may also contain this information, or a set of sub-panels for display directly underneath the primary displayed numbers on the display perimeter 214 may also be provided. The location of any highly successful wagering events or streaks may also be identified on the overhead display. This is especially beneficial in systems where players may place wagers on positions of other players, or on groups or sections of players.

For example, rather than a standard wagering tree showing a history of individual outcomes on the underlying game, the system may report specific player results, specific groups or areas (e.g., quadrant 3, or segment 9/10, or segment 3/10 row 2 of the array of player input terminals) and the system will allow any player to place wagers on what is perceived to be terminal(s) where significant success is being achieved. The individual terminals may therefore have the capability (by buttons, touchscreens and/or specific software) to place such systemic wagers. This would require a networked (hardwired or wireless) connection to the central game processor to account for and resolve such individual position wagers on other locations within the array of player terminals associated with the overhead display.

The underlying technology may have other features that act in concert with the underlying technology to offer additional benefits or improvements. The audio system may project sounds of the ball bouncing along the ribs between openings in the wheel, the panels on the display system may tilt (up and down) and/or twist (left and right rotations) to enhance the ability of the display to be viewed by all players. Where the displays are digital images, the displays of winning outcomes may expand across natural dimensions of individual panels to make the winning outcome appear larger. The displays may "flash" with different colors and/or different sizes and sounds. The display panels may also be raised and lowered with respect to its relative height from the floor and distance from the ceiling.

What is claimed:

1. A roulette system, comprising:

a wheel assembly comprising a wheel and a bowl with a circular upper track for accommodating a roulette ball, the upper track surrounds an annular lower track which is positioned above a circular recess, meets the upper track at a lower end of a circumference of the circular upper track, and slopes downwardly toward an inner diameter surrounding the circular recess;

N randomly numbered receptors, positioned within the circular recess and physically separate from the annular lower track, having N individual numbers between 0 and N−1 distributed among the N randomly numbered receptors, wherein N is at least 37; and an elevated display system supported overhead and separate from the wheel assembly, forming an arc including more than 200 degrees around the wheel assembly, wherein the elevated display system shows a dynamic rendition of wheel assembly game play on one or more display panels along an outer perimeter of the arc, the dynamic rendition includes at least a display of event outcomes from the wheel assembly game play, and the wagers are resolved based on the event outcomes.

2. The roulette system of claim 1, wherein attached to the wheel assembly above the circular upper track is a panel of multicolor light elements circumscribing the bowl and oriented to direct emitted light towards the receptors, wherein during rotation of the wheel at least some of the multicolor light elements varying light intensity to variably color at least a portion of the wheel assembly, wherein at least 70% of the light emission from the multicolor light emitting elements is emitted at an angle that is lower than a top portion of the wheel assembly opposite to a location of individual multicolor light emitting elements.

3. The roulette system of claim 2, wherein at least some of the multicolor light elements comprising light emitting diodes disposed on a single support strip circumscribing the wheel assembly.

4. The roulette system of claim 2, wherein the system is configured to mechanically impart ball movement and wheel rotation without manual effort, and after imparting of ball movement and wheel rotation, various light emitting elements of the multicolor light emitting elements automatically alter light emission intensity.

5. The roulette system of claim 1, wherein attached to the wheel assembly above the circular upper track is a panel of multicolor light elements circumscribing the bowl and oriented to direct emitted light towards the receptors, wherein during rotation of the wheel at least some of the multicolor light elements varying light intensity to variably color at least a portion of the wheel assembly, wherein the multicolor light elements comprise at least three distinctly colored light emitting elements.

6. The roulette system of claim 5, wherein at least some variation of light intensity includes individual ones of the multicolor light elements turning on and off.

7. The roulette system of claim 5, wherein at least some of the multicolor light elements comprising light emitting diodes disposed on a single support strip circumscribing the wheel assembly.

8. The roulette system of claim 5, wherein the system is configured to mechanically impart ball movement and wheel rotation without manual effort, and after imparting of ball movement and wheel rotation, various light emitting elements of the multicolor light emitting elements automatically alter light emission intensity.

9. The roulette system of claim 1, further comprising raised deflection elements disposed on the annular lower track and an audio system configured to automatically emit sounds of the roulette ball striking the deflection elements after a rotation speed of the wheel has reached a minimum speed.

10. The roulette system of claim 1, further comprising raised deflection elements disposed on the annular lower track and an audio system configured to automatically emit sounds of the roulette ball striking the deflection elements after a rotation speed of the wheel has reached a minimum speed.

11. The roulette system of claim 1, further comprising an audio system configured to automatically emit sounds of the roulette ball rolling within the circular upper track.

12. The roulette system of claim 11, wherein the audio system comprises multiple speakers distributed around the wheel assembly, and wherein the automatic emission of sounds simulates a changing physical location of the roulette ball within the wheel assembly by sequentially varying an intensity of sound from each speaker among the multiple speakers.

13. The roulette system of claim 1, wherein attached to the wheel assembly above the circular upper track is a panel of multicolor light elements circumscribing the bowl and oriented to direct emitted light towards the receptors, and wherein the system is configured to mechanically impart ball movement and wheel rotation without manual effort, and after imparting of ball movement and wheel rotation, various light emitting elements of the multicolor light emitting elements automatically alter light emission intensity.

14. The roulette system of claim 1 in combination with a display system for enabling group play for tables games selected from craps and roulette comprising:

a processor configured to receive event outcomes from outcomes on the roulette system from play of roulette;

multiple player input terminals distributed around a gaming table surface in an arc including more than 200 degrees around the gaming table surface; and the multiple player input terminals in two-way communication with the processor, the multiple player input terminals communicating wagers to the processor, and the processor communicating resolution of communicated wagers based on event outcomes from the play of roulette; and the wagers are resolved by the processor.

15. A method of executing a wagering event outcome on a roulette wheel system comprising:

a wheel assembly comprising a wheel and a bowl with a circular upper track for accommodating a roulette ball, the upper track surrounds an annular lower track which is positioned above a circular recess, meets the upper track at a lower end of a circumference of the circular upper track, and slopes downwardly toward an inner diameter surrounding the circular recess;

N randomly numbered receptors, positioned within the circular recess and physically separate from the annular lower track, having N individual numbers between 0 and N−1 distributed among the N randomly numbered receptors, wherein N is at least 37;

an elevated display system supported overhead and separate from the wheel assembly, forming an arc including more than 200 degrees around the wheel assembly;

an elevated display system supported overhead and separate from the wheel assembly, forming an arc including more than 200 degrees around the wheel assembly, wherein the elevated display system shows a dynamic rendition of wheel assembly game play on one or more display panels along an outer perimeter of the arc, the dynamic rendition includes at least a display of event outcomes from the wheel assembly game play, and the wagers are resolved based on the event outcomes; and wherein the method comprises rotating the wheel in a first direction of rotation and spinning the roulette ball within the circular upper track in a second direction of rotation opposite the first direction.

16. The method of claim 15, wherein attached to the wheel assembly above the circular upper track is a panel of multicolor light elements circumscribing the bowl and oriented to direct emitted light towards the receptors, and the method further comprising causing at least some of the multicolor light elements to vary in individual light intensity during at least a period of time while the wheel is rotating and the roulette ball is spinning.

17. The method of claim 16, wherein there are at least three different colors of multicolor light elements and variation in individual light intensity requires at least some of the individual multicolor light elements to turn on and off during rotation of the wheel and spinning of the roulette ball.

18. The method of claim 15, wherein the wheel assembly further comprises raised deflection elements disposed on the annular lower track and an audio system, and the method further comprising the audio system automatically emitting sounds of i) the roulette ball striking the deflection elements or ii) a sound of the roulette ball rolling within the circular upper track.

19. The method of claim 18, wherein a sensor determines rotation speed of the wheel and the audio system emits sounds dependent upon sensed speed of the wheel.

20. The method of claim 15, wherein multiple player input terminals are distributed around a gaming table surface in an arc including more than 200 degrees around the gaming table surface, and wherein the method further comprising the multiple player input terminals receiving wagers and resolving the wagers based on event outcomes from play of roulette on the wheel assembly.

* * * * *